United States Patent [19]

Isenring

[11] Patent Number: 4,593,767

[45] Date of Patent: Jun. 10, 1986

[54] IMPACT DEVICE

[76] Inventor: Fritz Isenring, Cnr. Beak & Butler Sts., Clinton Heights, Gladstone, Queensland, Australia, 4680

[21] Appl. No.: 652,547

[22] PCT Filed: Jul. 20, 1981

[86] PCT No.: PCT/AU81/00093

§ 371 Date: Mar. 30, 1982

§ 102(e) Date: Mar. 30, 1982

[87] PCT Pub. No.: WO82/00430

PCT Pub. Date: Feb. 18, 1982

Related U.S. Application Data

[63] Continuation of Ser. No. 364,935, Mar. 30, 1982, abandoned.

[30] Foreign Application Priority Data

Aug. 4, 1980 [AU] Australia ..... PE4857
Nov. 13, 1980 [AU] Australia ..... PE6476

[51] Int. Cl.[4] ..... B25D 11/00
[52] U.S. Cl. ..... 173/98; 29/81 D
[58] Field of Search ..... 173/49, 94, 98, 99, 173/50, 51; 29/81 D

[56] References Cited

U.S. PATENT DOCUMENTS

| | | | |
|---|---|---|---|
| 1,464,570 | 8/1923 | Hage | 173/98 |
| 1,580,202 | 4/1926 | Jaffrennou | 173/98 |
| 1,707,887 | 4/1929 | Wagner | 173/98 |
| 1,725,212 | 8/1929 | Schneider | 173/99 |
| 1,824,935 | 9/1931 | Thompson | 173/98 |
| 2,019,931 | 11/1935 | Rasch | 173/99 |
| 2,233,913 | 4/1941 | Colestock | 173/98 |
| 2,248,523 | 7/1941 | Francastel | 173/98 |
| 3,680,643 | 8/1972 | Cameron et al. | 29/81 D |

FOREIGN PATENT DOCUMENTS

| | | |
|---|---|---|
| 463948 | 8/1928 | Fed. Rep. of Germany . |
| 264049 | 1/1927 | United Kingdom . |

*Primary Examiner*—E. R. Kazenske
*Assistant Examiner*—James L. Wolfe
*Attorney, Agent, or Firm*—Sughrue, Mion, Zinn, Macpeak, and Seas

[57] ABSTRACT

Impact device comprising a housing with a rotatable impeller located eccentrically therein. The impeller includes masses located in radial apertures which, upon rotation of the impeller, are caused to strike the head of an impact tool extending at least partially into the cavity within the housing formed by the eccentric location of the impeller.

1 Claim, 8 Drawing Figures

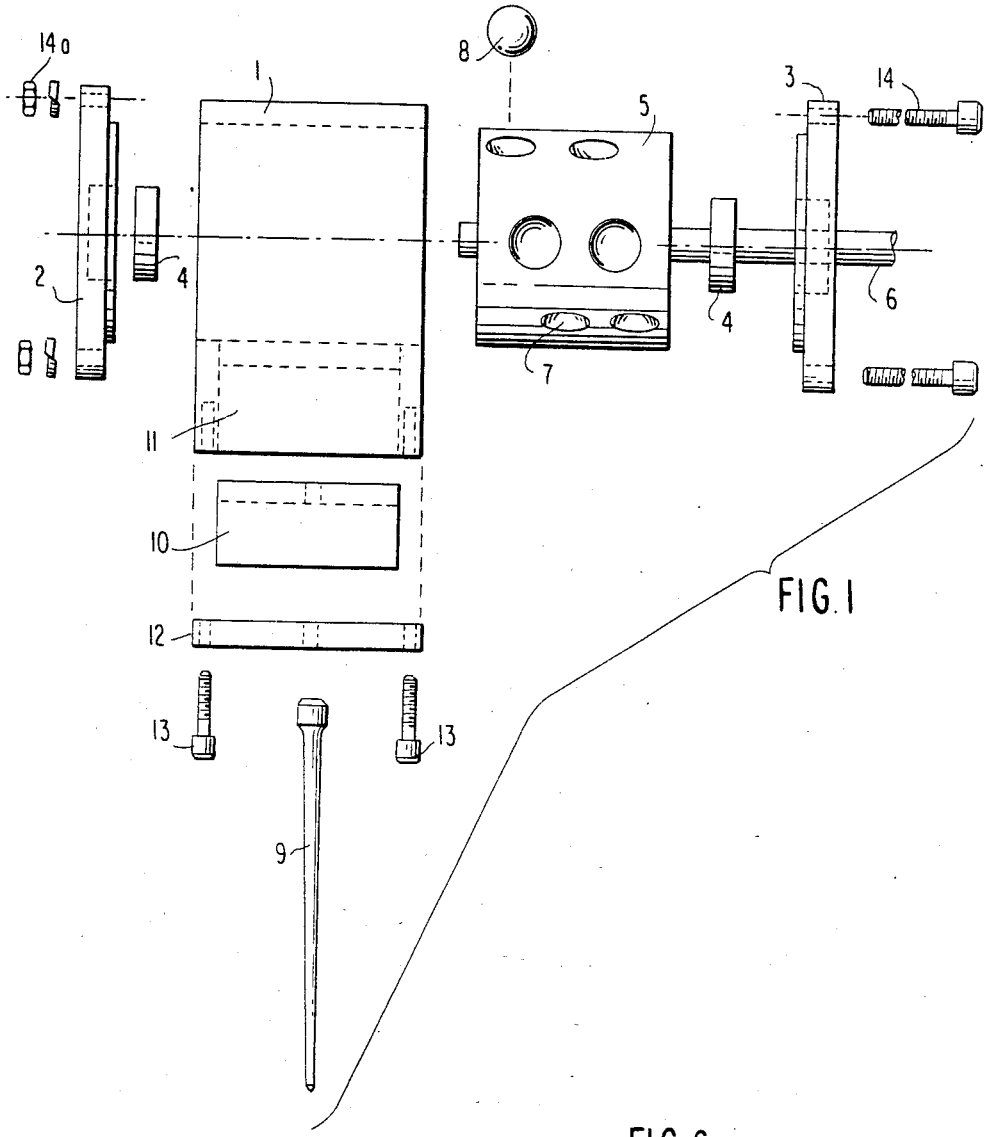
FIG. 1
FIG. 6
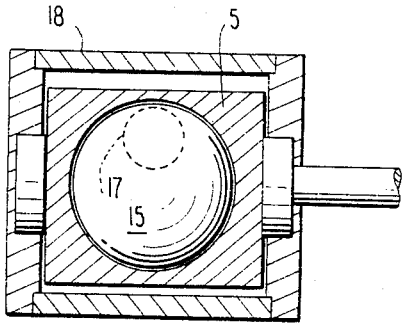

IMPACT DEVICE

This is a continuation of application Ser. No. 364,935, filed Mar. 30, 1982, now abandoned.

BACKGROUND OF THE INVENTION

The present invention relates to improvements in impact devices and particularly although not exclusively to impact hammers and like devices such as needle guns.

Needle guns generally comprise a number of hardened steel rods or "needles", tapered at one end and retainably mounted in a housing with the tapered or pointed ends extending outwardly. The retained ends of the needles are subjected to a "hammering" action generally by a rotating hammer or anvil device.

Needle guns and impact chisels may be used for a variety of purposes including removal of rust, dirt, paint or other coatings from surfaces prior to painting or other treatment. In addition, welding slag is readily removable from welded surfaces by the use of a needle gun or impact chisel. Needle guns have been found to be particularly suitable for roughening the surface of cured concrete where reconcreting is required.

Prior art impacting devices such as needle guns, impact hammers and impact chisels have generally suffered the disadvantages of being heavy and cumbersome in size and in operation, subject to considerable vibration. In addition, prior art impact devices have not been particularly efficient in their operation, especially when operating on uneven surfaces.

SUMMARY OF THE INVENTION

The impact device of the present invention aims to alleviate the disadvantages of prior art impact devices and provide an improved impact device of reduced weight and bulk, greater ease of operation through reduced vibration and more efficient operation.

According to the invention there is provided an impact device comprising:

a body adapted to house a rotatable member;

a rotatable member located within said body, said rotatable member including one or more apertures adapted to receivably locate energy transfer means;

one or more energy transfer means movably located within said one or more apertures; and, impact means associated with said body, whereby in use, rotation of said rotatable member causes energy to be imparted to said impact means by said energy transfer means.

Preferably said body comprises a hollow essentially cylindrical aperture defining an inner wall surface. Suitably at least a portion of said inner wall surface is outwardly divergent adjacent the impact means to enhance energy transfer between said energy transfer means and said impact means. More suitably, the body comprises means to eccentrically locate the rotatable member for rotation therewithin. Most suitably, the rotatable member is located within said body for rotation about an axis essentially parallel to and spaced from a central axis of said body.

Preferably the rotatable member comprises one or more apertures extending inwardly of an outer peripheral surface thereof. Suitably the rotatable member comprises a plurality of apertures extending substantially radially inwardly of said outer peripheral surface.

Preferably the energy transfer means is adapted in use to be urged toward the impact means to impact energy thereto. Suitably the energy transfer means is urged toward the impact means under the influence of centrifugal force. Most suitably the energy transfer means is adapted in use to engage the inner wall of the body for rolling engagement therewith.

Preferably the impact means includes support means for one or more impact tools, said support means being associated with the body to retainably locate said one or more impact tools for cooperation in use with said energy transfer means.

Suitably the support means comprises guide means for retaining said one or more impact tools in desired alignment relative to said body.

BRIEF DESCRIPTION OF THE DRAWINGS

Certain embodiments of the invention will now be described with reference to the accompanying drawings in which:

FIG. 1 illustrates an exploded view of a needle gun constructed according to the invention;

FIG. 6 illustrates a cross-sectional view from above of the embodiment illustrated in FIG. 5;

DETAILED DESCRIPTION OF THE INVENTION

Figure 4:
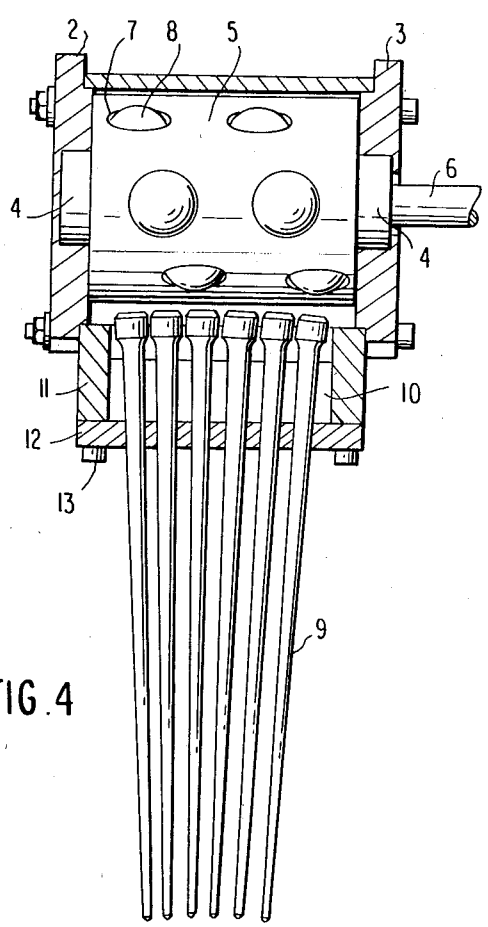
FIG. 4 illustrates a sectional side elevation of the apparatus of FIG. 2.
Figure 3:
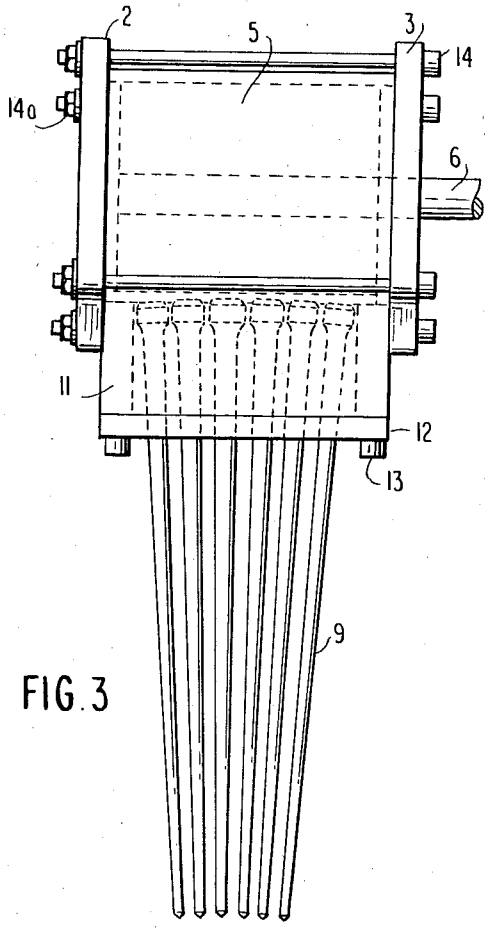
FIG. 3 illustrates a side elevation of the apparatus of FIG. 2.
Figure 2:
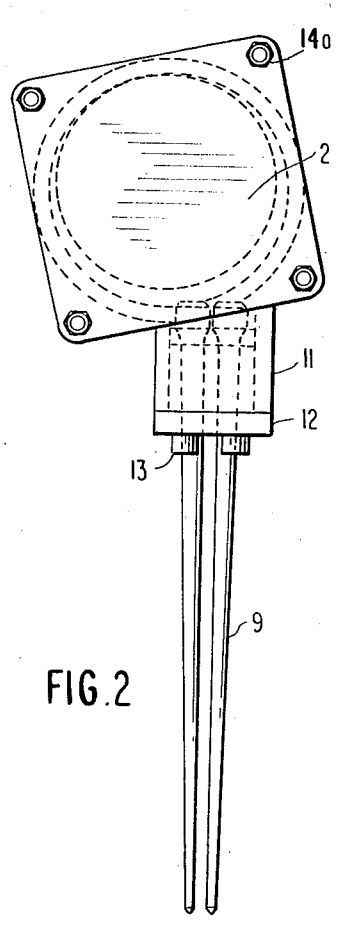
FIG. 2 illustrates an end elevation of the needle gun of FIG. 1.

The invention will now be described with reference to a first embodiment of the invention wherein the impact device is a needle gun.

In FIG. 1 the needle gun preferably comprises a generally cylindrical hollow body 1 which may be of a suitable material such as hardened steel. End plates 2 and 3 may be provided in which suitable bearing means 4 such as ball races are located.

The rotatable member 5 suitably comprises a generally cylindrical member which may have an axial shaft 6 at each end to support the rotatable member 5 in the end plate bearing 4 and locate the member within the hollow body or housing 1. One shaft end is preferably extended to permit rotation of the member by a drive means such as an electric motor (not shown). The rotatable member may be provided with a number of hollow apertures 7 about its arcuate peripheral surface to receive and locate the energy transfer means. The diameter of the rotatable member 5 is preferably less than the internal diameter of the hollow housing 1 to provide a space therebetween. The assembly is suitably connected by bolts 14 and nuts 14*a*.

The energy transfer means in this embodiment comprises bodies of suitable shape and mass such as hardened steel balls 8.

The impact means may comprise a number of tapered or sharpened hardened steel pins 9 which are suitably located and retained in a guide means 10 situated within a support housing 11 on body 1. The assembly is held together by means of an apertured bottom plate 12 attached to support housing 11 by bolts 13.

On rotation of the rotatable member or impeller, the balls 8 are permitted to strike the heads of the pins 9 and thus transfer at least part of their kinetic energy to the pins to effect an impact on the pins. Preferably the impeller is located eccentrically within the housing such that the major clearance therebetween is in the region of the heads of the pins.

On rotation of the impeller 5, the balls 8 are retained in the impeller apertures 7 by the housing 1 but limited radial movement is permitted by the eccentric location of the impeller within the housing. The balls 8 thus effect a "hammering" action on the heads of the pins 9 as the impeller 5 is rotated.

The apertures may comprise radially formed cylindrical cavities and may be arranged in an essentially helical fashion about the periphery of the cylindrical surface of the impeller. In this manner, a row of pins 9 arranged in guide 10 with their heads extending along the length of the inner surface of the housing may undergo progressive impacts from the balls as the impeller rotates. In this embodiment, two rows of pins 9 can be arranged, side by side, along the length of the housing such that as the impeller rotates, each pin is struck twice by successive balls in the course of each rotation. For example, in the embodiment illustrated in FIGS. 1–4 of the accompanying drawings, with the impeller rotating at 3000 r.p.m., each of the six pins is struck four times per revolution giving a total of 72,000 impacts per minute.

The progressive striking action on the pins substantially reduces the vibration of the device compared with a device in which all the pins are struck simultaneously. A further advantage arising from the progressive striking action is realized when the device is used on an uneven surface. Should one pin be pushed up further than the others by a surface irregularity, the ball which strikes that pin will simply be pushed further back into its cavity in the impeller. It can clearly be seen therefore that even on an uneven surface, each pin will receive a substantially similar impact. A further advantage accruing from the reduced vibration of the device according to the invention is that a more compact and lighter weight construction is permissable over similar impact devices with a conventional striker action.

It is envisaged that the constructional features and operating principle of the invention may, with suitable modifications, be adapted to an impact hammer or impact chisel with a single impact means.

Figure 5:
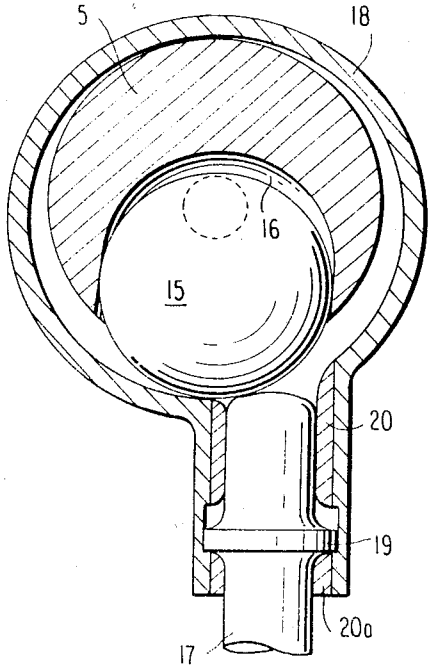
FIG. 5 illustrates an end cross-sectional view of an alternative embodiment of the invention modified for use with a single impact tool.

For example, FIGS. 5 and 6 of the accompanying drawings illustrate an embodiment of the invention adapted for use as an impact hammer or impact chisel comprising a single energy transfer device and a single impact means.

The energy transfer means may be of greater mass than the eccentrically mounted impeller to impact a large amount of force to the impact tool but generally this is achieved by suitably selecting the speed of rotation of the impeller and/or by suitably selecting the radius of rotation of the impeller. The device may comprise a spherical ball 15 mounted in an essentially cylindrical aperture 16 with a radial axis. Alternatively the device may comprise an essentially cylindrical energy transfer means located within a parallel sided aperture essentially parallel to the axis of rotation of the impeller. The impact tool 17 comprising an impact hammer or impact chisel may be retained in the body 18 of the device by a retaining collar 19 on the tool located in an aperture formed in guide sleeves 20 and **20*a***.

A rotatable energy transfer means such as a spherical ball, cylindrical body or rotatable disc is the most preferred form of energy transfer means. As the impeller rotates, the energy transfer means is forced outwardly against the housing whereby the frictional force between the energy transfer means and the inner wall of the housing body is greater than that between the energy transfer means and the walls of the impeller aperture. Accordingly, the rotatable energy transfer means is caused to rotate as it travels in a planetary fashion about the inner periphery of the housing body. It will be readily apparent to a skilled addressee that the planetary motion of the energy transfer device permits considerably reduced wear of the component parts. In addition it will be apparent that as the rolling body of the energy transfer means contact the impact tool, the force imparted is essentially radially directed downwardly through the major axis of the tool resulting in improved efficiency due to reduced friction losses in the tool guide means 20 and **20*a***.

The impact tool may be restrained from rotation within the guide by suitably shaping the guide aperture and the shank of the impact tool or alternatively the impact tool may be free to rotate. The impact tools are preferably mounted directly in the guide apertures but alternatively the tools may be mounted via a socket and spigot arrangement in a follower mounted in the guide apertures.

Depending on the end use of the impact tool, certain modifications may improve the operating efficiency and at the same time assist in reducing wear on the component parts and provide greater operator comfort.

Figure 7:
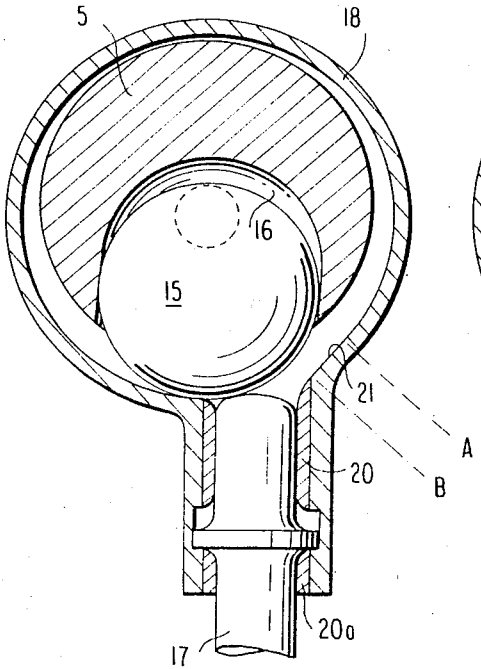
FIG. 7 illustrates a modified form of FIG. 5.

In FIG. 7 portion 21 of the internal wall of the housing between A and B may be formed as a straight or trangential portion rather than radiussed approach ramp to permit the energy transfer means to adopt an essentially tangential direction immediately prior to striking the impact tool. In this manner, rolling friction between the energy transfer means and the inner wall of the housing due to centripetal force is substantially reduced just prior to impact and the angle at which the energy transfer means strikes the tool is increased thus increasing the efficiency of energy transfer. This modification is suitable to all embodiments of the present invention.

Figure 8:
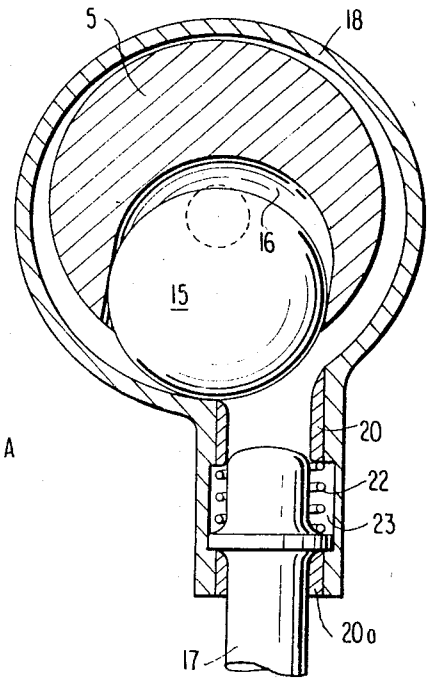
FIG. 8 illustrates yet a further modified form of the invention.

FIG. 8 illustrates a modification wherein the head of the impact tool may be positioned below the inner wall surface of the housing to reduce unnecessary wear and vibration in the device while the impeller is rotating without application of a load to the tool 17. The head of the impact tool is thus only brought into position to engage the energy transfer means when a load is applied between the impact tool and a surface to be impacted. A spring biassing means 22 is provided within a cavity 23 in the tool guide to retain the tool in a retracted position away from the energy transfer means. The spring or like biassing means is not essential as the impact tool, in an upright position would normally be retracted under the influence of gravitational force. The biassing means would be useful where the impact tool is used in an inverted position. This modification is particularly applicable to a device according to the invention wherein the energy transfer means comprises one or more cylindrical rollers which span the aperture(s) through which the head(s) of the impact tool(s) extend into the housing cavity. With the tool in the retracted position, the energy transfer means is permitted to roll smoothly around the inner periphery of the housing without unnecessary vibration and wear.

The invention also contemplates a number of alternative embodiments.

In one alternative embodiment the energy transfer means may comprise an essentially cylindrical body comprising a number of disc-like elements arranged in side by side relationship within one or several apertures in the impeller or the disc may be arranged within a number of apertures about the periphery of the impellar. In another alternative embodiment the energy transfer means may comprise a non-rotatable body such as one or more essentially cylindrical or like shaped bodies arranged in corresponding apertures in the impeller with the major axes of the bodies arranged radially of the impeller. The outwardly disposed end of the body may be rounded or hemispherical to reduce the area of frictional contact with the housing inner wall. In any of the above embodiments, a resilient biassing means may be provided between the energy transfer means and the inwardmost portion of the aperture in the impeller to provide an additional radially outwardly directed force on the energy transfer means. Such a biasing means would normally only be required for slow speed operation or low momentum impact using a low mass energy transfer means.

In yet a further alternative embodiment, the energy transfer means may comprise one or more members pivotally mounted to a centrally or eccentrically positioned rotating member within the housing body. The members are preferably adapted to permit maximum energy transfer to the impact tool or tools (i.e. mass concentration towards outer edge of member) and the outer edge may be shaped to permit smooth contact between the end of the impact tool and/or the inner wall of the housing body. Alternatively, rotatable energy transfer means may be radially slidably mounted within said pivotal members.

The device may be adapted to be attached to an electric, hydraulic, pneumatic or other means capable of imparting rotary motion to the impeller by direct or indirect coupling or alternatively the impact device may be constructed with an integrally mounted motor.

The present invention further comtemplates the use of many embodiments of the impact device in any situation where impact and/or vibrational forces are required. For example, the invention could be embodied in a jackhammer, a sculptor's chisel, a compaction device for earth compaction, vibrating tools for freshly poured concrete and the like or even industrial machinery such as metal shaping, punching etc. In for example a mining operation a number of impact devices may be interconnected by a common drive shaft with suitably spaced universal joints whereby a number of operators may work essentially side by side. Alternatively the devices may be mounted on a frame with essentially rigid drive shafts interconnecting the devices.

It will be readily apparent to a skilled addressee that many combinations of impeller and energy transfer means are contemplated by the present invention depending on the end use requirements of the impact tool and that a wide range of impeller speeds may be employed e.g. from say 50–50,000 r.p.m.

I claim:

1. An impact device comprising a hollow cylindrical body having an inner wall surface, a rotatable member located within said body for rotation about a rotational axis, said rotatable member being comprised of a cylindrical element having at least three radially disposed apertures therein arranged along a helical line extending about the periphery of said cylindrical element, energy transfer means located in each aperture for radial movement therein and disposed in engagement with said inner wall surface of said body for movement along a substantially circulr path upon rotation of said rotatable member and impact means supported and constrained for limited linear movement with one end of said impact means being engageable with said energy transfer means, said impact means being comprised of a row of pins disposed in a straight line parallel to the axis of said cylindrical element whereby upon rotation of said rotatable member said energy transfer means located in each aperture will sequentially engage said impact members under the direct influence of centrifugal force thereby imparting energy to said impact means to effect said linear movement.

* * * * *